US009033049B2

(12) United States Patent
Kotrla et al.

(10) Patent No.: US 9,033,049 B2
(45) Date of Patent: May 19, 2015

(54) BLOWOUT PREVENTER SHUT-IN ASSEMBLY OF LAST RESORT

(76) Inventors: Johnnie E. Kotrla, Katy, TX (US); Ross Stevenson, Magnolia, TX (US); Johnny Everett Jurena, Cypress, TX (US); Paul Toudouze, The Woodlands, TX (US)

( * ) Notice: Subject to any disclaimer, the term of this patent is extended or adjusted under 35 U.S.C. 154(b) by 604 days.

(21) Appl. No.: 13/293,346

(22) Filed: Nov. 10, 2011

(65) Prior Publication Data

US 2013/0118755 A1 May 16, 2013

(51) Int. Cl.

| | |
|---|---|
| ***E21B 7/12*** | (2006.01) |
| ***E21B 33/064*** | (2006.01) |
| ***E21B 33/035*** | (2006.01) |
| ***E21B 41/00*** | (2006.01) |

(52) U.S. Cl.

CPC ..... *E21B 33/064* (2013.01); *E21B 33/0355* (2013.01); *E21B 41/0007* (2013.01)

(58) Field of Classification Search

CPC ..... E21B 33/06; E21B 33/064; E21B 47/12

USPC ..... 166/338, 360, 363, 368, 250.01, 85.4; 137/315.02; 251/1.1

See application file for complete search history.

(56) References Cited

U.S. PATENT DOCUMENTS

| | | | | |
|---|---|---|---|---|
| 4,210,208 | A * | 7/1980 | Shanks | 166/352 |
| 6,478,087 | B2 * | 11/2002 | Allen | 166/255.1 |
| 6,672,390 | B2 * | 1/2004 | Azancot | 166/341 |
| 6,752,100 | B2 * | 6/2004 | Guinn et al. | 114/258 |
| 7,921,917 | B2 * | 4/2011 | Kotrla et al. | 166/339 |
| 8,365,830 | B2 * | 2/2013 | Kotrla et al. | 166/338 |
| 8,640,775 | B2 * | 2/2014 | Kotrla et al. | 166/338 |
| 2007/0107904 | A1 | 5/2007 | Donahue et al. | |
| 2010/0227551 | A1 * | 9/2010 | Volanthen et al. | 455/40 |

FOREIGN PATENT DOCUMENTS

| | | | |
|---|---|---|---|
| EP | 1519002 | A1 | 3/2005 |
| WO | 2010117350 | A1 | 10/2010 |

OTHER PUBLICATIONS

PCT International Search Report and Written Opinion for PCT/US2012/063814, dated Mar. 22, 2013.

* cited by examiner

*Primary Examiner* — Matthew Buck
*Assistant Examiner* — Aaron Lembo
(74) *Attorney, Agent, or Firm* — Chamberlain Hrdlicka

(57) ABSTRACT

A system for drilling and/or producing a subsea wellbore comprises a primary BOP comprising a primary ram BOP. In addition, the system comprises a secondary BOP releasably connected to the primary BOP, the secondary BOP comprising a secondary ram BOP. The primary rain BOP is actuatable by a first control signal. The secondary ram BOP is actuatable by a second control signal. The secondary rain BOP is not actuatable by the first control signal.

29 Claims, 5 Drawing Sheets

BLOWOUT PREVENTER SHUT-IN ASSEMBLY OF LAST RESORT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field of the Invention

The present invention relates generally to the configuration, deployment, and operation of pressure control equipment used in drilling subsea wells. More particularly, the present invention relates to an independently controlled backup blowout preventer assembly that can assist containment of a subsea wellbore in the event of a failure or malfunction of the primary subsea blowout preventer stack, the primary blowout preventer control system, the subsea/surface communication conduits, the surface rig systems or combinations thereof.

2. Background of the Technology

In most offshore drilling operations, a wellhead at the sea floor is positioned at the upper end of the subterranean wellbore lined with casing, a blowout preventer (BOP) stack is mounted to the wellhead, and a lower marine riser package (LMRP) is mounted to the BOP stack. The upper end of the LMRP typically includes a flex joint coupled to the lower end of a drilling riser that extends upward to a drilling vessel at the sea surface. A drill string is hung from the drilling vessel through the drilling riser, the LMRP, the BOP stack, and the wellhead into the wellbore.

During drilling operations, drilling fluid, or mud, is pumped from the sea surface down the drill string, and returns up the annulus around the drill string. In the event of a rapid invasion of formation fluid into the annulus, commonly known as a "kick", the BOP stack and/or LMRP may actuate to help seal the annulus and control the fluid pressure in the wellbore. In particular, the BOP stack and LMRP include closure members, or cavities, designed to help seal the wellbore and prevent the release of high-pressure formation fluids from the wellbore. Thus, the BOP stack and LMRP function as pressure control devices.

For most subsea drilling operations, the BOP stack and LMRP are operated with a common control system physically located on the surface drilling vessel. However, damage to the drilling vessel from a blowout, ballast control issue, collision, power failure, etc., may result in damage and/or complete loss of the control system and/or the ability to operate the BOP stack. In such cases, the subsea BOP stack and LMRP may be rendered useless, even if intact, because there is no readily available means to actuate or operate them.

Accordingly, there remains a need in the art for systems and methods to help control a subsea well in the event of a blowout. Such systems and methods would be particularly well-received if they offered the potential to remotely control and seal the well independent of the primary control system housed on the surface drilling vessel.

BRIEF SUMMARY OF THE DISCLOSURE

These and other needs in the art are addressed by a system for drilling and/or producing a subsea wellbore. In an embodiment, the system comprises a primary BOP comprising a primary rain BOP. In addition, the system comprises a secondary BOP releasably connected to the primary BOP, the secondary BOP comprising a secondary rain BOP. The primary ram BOP is actuatable by a first control signal. The secondary ram BOP is actuatable by a second control signal. The secondary rain BOP is not actuatable by the first control signal.

These and other needs in the art are addressed by another embodiment for a method for containing a subsea wellbore. In that embodiment, the method comprises (a) lowering a backup BOP subsea and mounting the backup BOP to a subsea wellhead at an upper end of the wellbore, wherein the backup BOP includes at least one rain BOP. In addition, the method comprises (b) lowering a primary BOP subsea and connecting the primary BOP to the backup BOP after (a). The primary BOP includes at least one ram BOP. Further, the method comprises (c) coupling a first control system to the primary BOP. Still further, the method comprises (d) coupling a second control system to the backup BOP. The first control system is configured to only control the primary BOP and the second control system is configured to only control the backup BOP.

These and other needs in the art are addressed in another embodiment by a system for drilling and/or producing a subsea wellbore. In an embodiment, the system comprises a primary BOP stack comprising a plurality of axially stacked rain BOPs. In addition, the system comprises a backup BOP releasably connected to the primary BOP stack, the secondary BOP comprising at least one ram BOP. Further, the system comprises a first control system configured to operate each rain BOP of the primary BOP stack. Still further, the system comprises a second control system configured to operate each rain BOP of the backup BOP. The first control system includes an operator control panel disposed on a first vessel and a pair of redundant subsea control pods coupled to the primary BOP stack. The second control system includes an operator control panel disposed on a second vessel and a pair of redundant subsea control units coupled to the backup BOP.

These and other needs in the art are addressed in another embodiment by a system. In an embodiment, the system comprises a first control system configured to operate a plurality of ram BOPs of a primary BOP stack. In addition, the system comprises a second control system configured to operate at least one rain BOP of a backup BOP. The first control system includes an operator control panel disposed on a first vessel and a pair of redundant subsea control pods for operating the rain BOPs of the primary BOP stack. The second control system includes an operator control panel disposed on a second vessel and a pair of redundant subsea control units for operating the rain BOP of the backup BOP.

Embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF EMBODIMENTS

Figure 1:
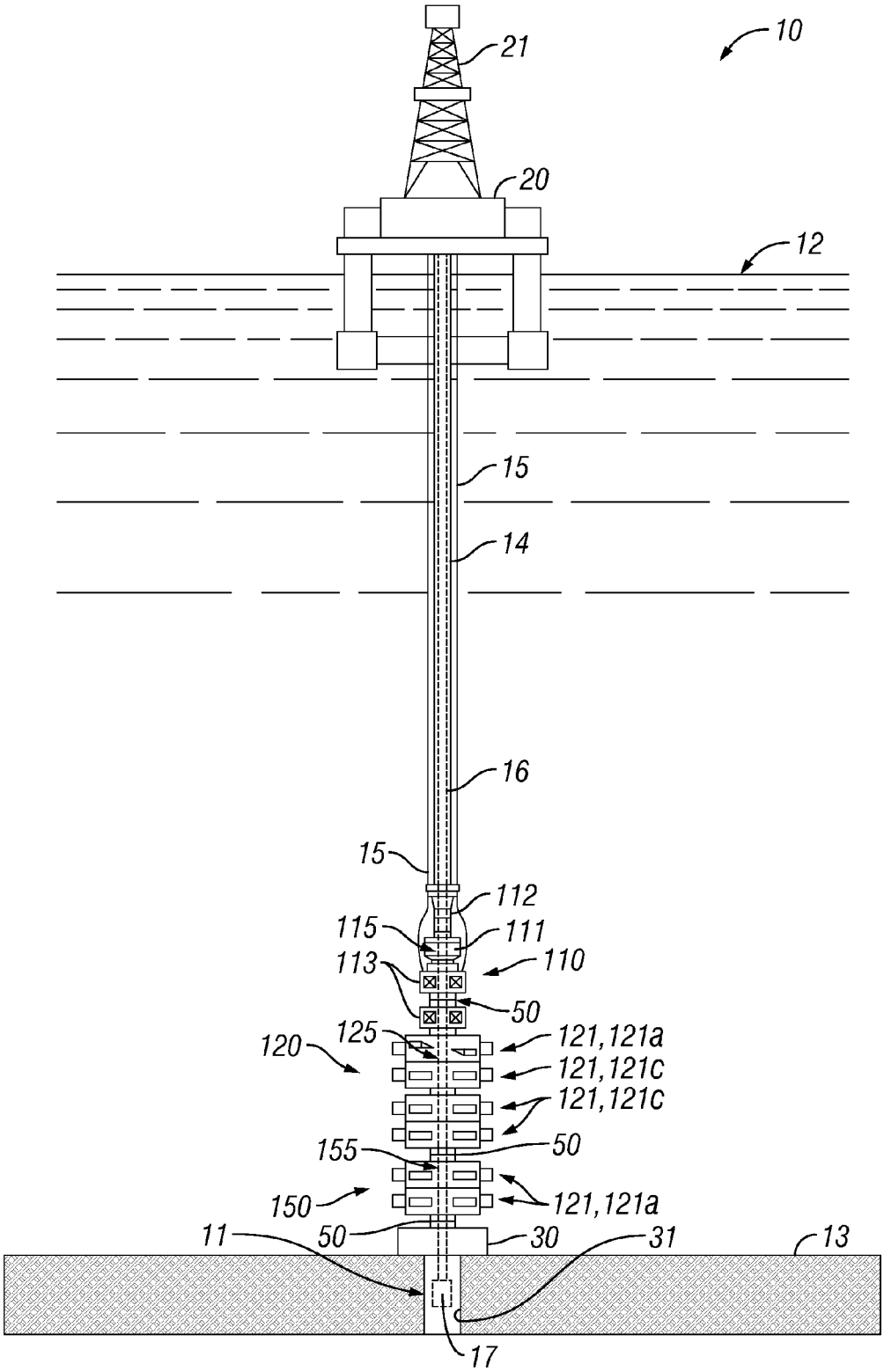
FIG. 1 is a schematic view of an embodiment of an offshore system for drilling and/or producing a subterranean wellbore.

The following discussion is directed to various exemplary embodiments. However, one skilled in the art will understand that the examples disclosed herein have a broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Referring now to FIG. 1, an embodiment of an offshore system 10 for drilling and/or producing a wellbore 11 is shown. In this embodiment, system 10 includes an offshore vessel or platform 20 at the sea surface 12 and a subsea BOP stack assembly 100 mounted to a wellhead 30 at the sea floor 13. Platform 20 is equipped with a derrick 21 that supports a hoist (not shown). A tubular drilling riser 14 extends from platform 20 to BOP stack assembly 100. Riser 14 returns drilling fluid or mud to platform 20 during drilling operations. One or more hydraulic conduit(s) 15 extend along the outside of riser 14 from platform 20 to BOP stack assembly 100. Conduit(s) 15 supply pressurized hydraulic fluid to assembly 100. Casing 31 extends from wellhead 30 into subterranean wellbore 11.

Downhole operations are carried out by a tubular string 16 (e.g., drillstring, production tubing string, coiled tubing, etc.) that is supported by derrick 21 and extends from platform 20 through riser 14, through the BOP stack assembly 100, and into the wellbore 11. A downhole tool 17 is connected to the lower end of tubular string 16. In general, downhole tool 17 may comprise any suitable downhole tool(s) for drilling, completing, evaluating and/or producing wellbore 11 including, without limitation, drill bits, packers, cementing tools, casing or tubing running tools, testing equipment, perforating guns, and the like. During downhole operations, string 16, and hence tool 17 coupled thereto, may move axially, radially, and/or rotationally relative to riser 14 and BOP stack assembly 100.

Figure 2:
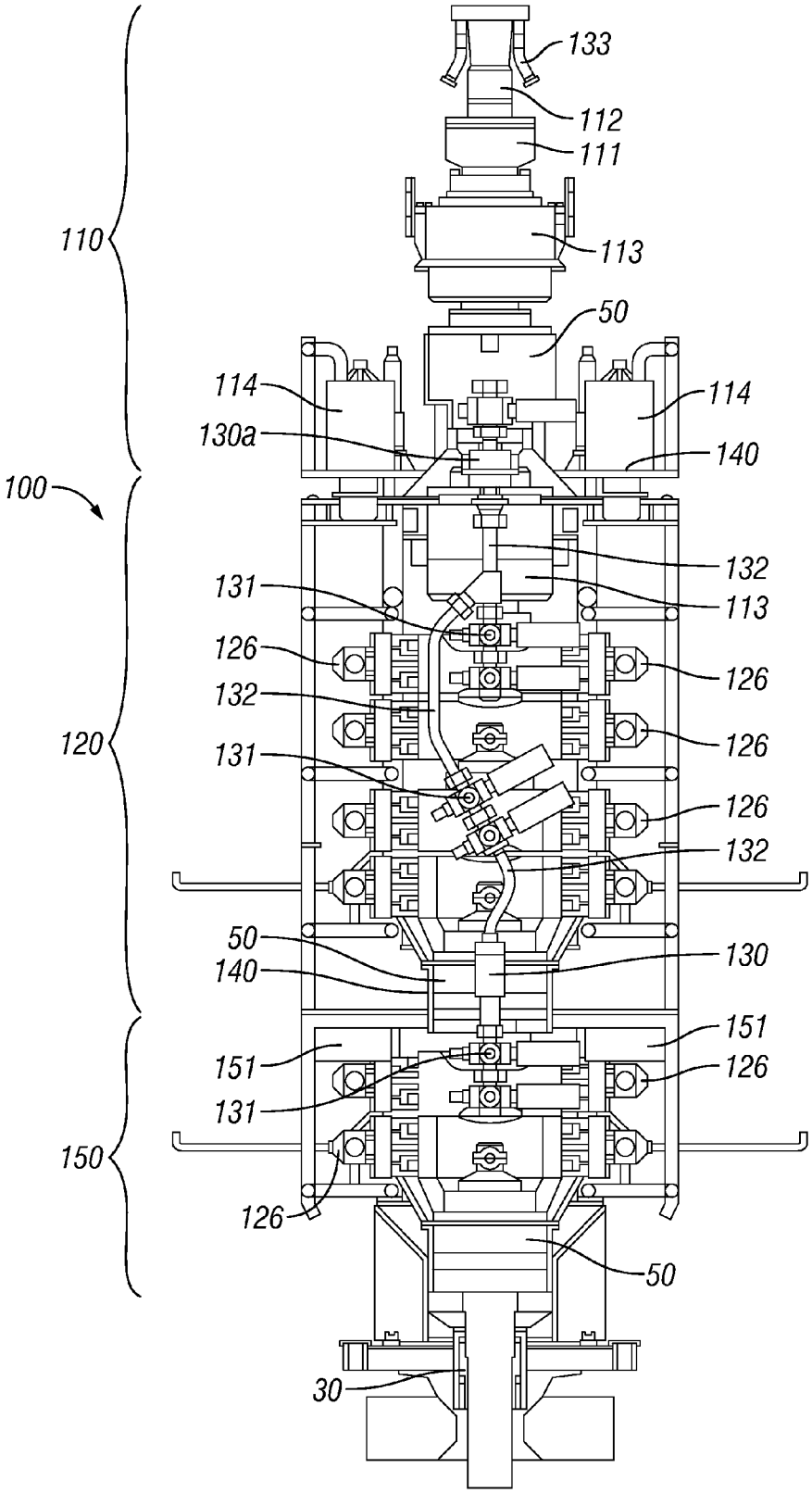
FIG. 2 is an elevation view of an embodiment of the subsea BOP stack assembly of FIG. 1.
Figure 3:
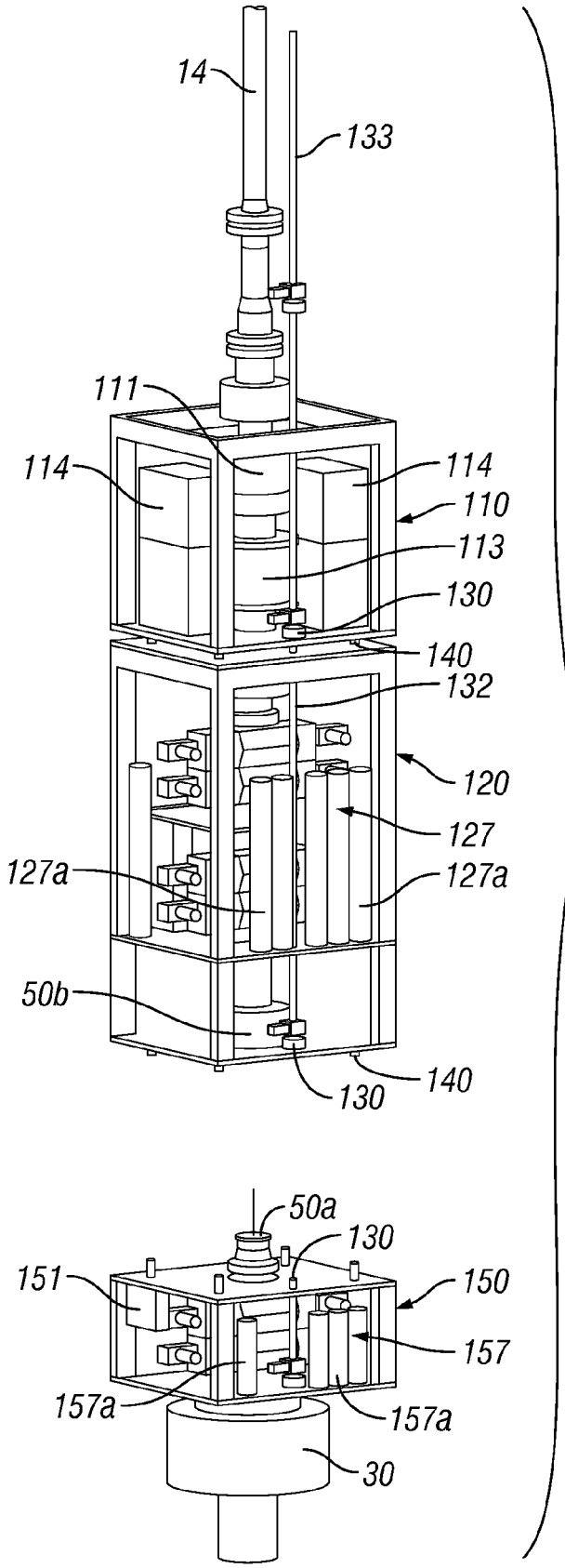
FIG. 3 is a perspective exploded view of the subsea BOP stack assembly of FIGS. 1 and 2.

Referring now to FIGS. 1-3, BOP stack assembly 100 is mounted to wellhead 30 and is designed and configured to control and seal wellbore 11, thereby containing the hydrocarbon fluids (liquids and gases) therein. In this embodiment, BOP stack assembly 100 comprises a lower marine riser package (LMRP) 110, a primary BOP or BOP stack 120, and a secondary BOP or BOP stack 150. As will be described in more detail below, secondary BOP stack 150 serves as a backup to primary BOP stack 120 and LMRP 110 in the event primary BOP stack 120 and/or LMRP 110 fail, malfunction, or lose control communication with vessel 20. Accordingly, secondary BOP stack 150 may also be referred to as a backup BOP stack or a BOP stack of last resort.

Secondary BOP stack 150 is releasably secured to wellhead 30, primary BOP stack 120 is releasably secured to LMRP 110 and secondary BOP stack 150, and LMRP 110 is releasably secured to primary BOP stack 120 and riser 14. In this embodiment, the connections between wellhead 30, secondary BOP stack 150, primary BOP stack 120, and LMRP 110 comprise hydraulically actuated, mechanical wellhead-type connections 50. In general, connections 50 may comprise any suitable releasable wellhead-type mechanical connection such as the DWHC or HC profile subsea wellhead system available from Cameron International Corporation of Houston, Tex., or any other such wellhead profile available from several subsea wellhead manufacturers. Typically, such hydraulically actuated, mechanical wellhead-type connections (e.g., connections 50) comprise an upward-facing male connector or "hub," labeled with reference numeral 50*a* herein, that is received by and releasably engages a downward-facing mating female connector or receptacle, labeled with reference numeral 50*b* herein. In this embodiment, the connection between LMRP 110 and riser 14 is a flange connection that is not remotely controlled, whereas connections 50 may be remotely, hydraulically controlled.

Referring still to FIGS. 1-3, LMRP 110 comprises a riser flex joint 111, a riser adapter 112, an annular BOP 113, and a pair of redundant control units or pods 114. A flow bore 115 extends through LMRP 110 from riser 14 at the upper end of LMRP 110 to connection 50 at the lower end of LMRP 110. Riser adapter 112 extends upward from flex joint 111 and is coupled to the lower end of riser 14. Flex joint 111 allows riser adapter 112 and riser 14 connected thereto to deflect angularly relative to LMRP 110 while wellbore fluids flow from wellbore 11 through BOP stack assembly 100 into riser 14. Annular BOP 113 comprises an annular elastomeric sealing element that is mechanically squeezed radially inward to seal on a tubular extending through LMRP 110 (e.g., string 16, casing, drillpipe, drill collar, etc.) or seal off bore 115. Thus, annular BOP 113 has the ability to seal on a variety of pipe sizes and/or profiles, as well as perform a "Complete Shut-off" (CSO) to seal bore 115 when no tubular is extending therethrough.

In this embodiment, primary BOP stack 120 comprises an annular BOP 113 as previously described, choke/kill valves 131, and choke/kill lines 132. Choke/kill line connections 130 connect the female choke/kill connectors of LMRP 110 with the male choke/kill adapters of primary BOP stack 120, thereby placing the choke/kill connectors of the LMRP 110 in fluid communication with choke lines 132 of primary BOP stack 120. A main bore 125 extends through primary BOP stack 120 from LMRP 110 at the upper end of stack 120 to backup BOP stack 150 at the lower end of stack 120. In addition, primary BOP stack 120 includes a plurality of axially stacked ram BOPs 121. Each rain BOP 121 includes a pair of opposed rains and a pair of actuators 126 that actuate and drive the matching rams. In this embodiment, primary BOP stack 120 includes four rain BOPs 121—an upper ram BOP 121 including opposed blind shear rains or blades 121*a* for severing tubular string 16 and sealing off wellbore 11 from riser 14; and three lower ram BOPs 120 including opposed pipe rains 121*c* for engaging string 16 and sealing the annulus around tubular string 16. In other embodiments, the primary BOP stack (e.g., stack 120) may include a different number of rains, different types of rains, one or more annular BOPs, or combinations thereof. As will be described in more detail below, control pods 114 operate valves 131, rain BOPs, and annular BOPs 113 of LMRP 110 and primary BOP stack 120.

Opposed rams 121*a, c* are located in cavities that intersect main bore 125 and support rams 121*a, c* as they move into and out of main bore 125. Each set of rams 121*a, c* is actuated and transitioned between an open position and a closed position by matching actuators 126. In particular, each actuator 126 hydraulically moves a piston within a cylinder to move a connecting rod coupled to one ram 121*a, c*. In the open positions, rams 121*a, c* are radially withdrawn from main bore 125. However, in the closed positions, rams 121*a, c* are radially advanced into main bore 125 to close off and seal main bore 125 (e.g., rams 121*a*) or the annulus around tubular string 16 (e.g., 121*c*). Main bore 125 is substantially coaxially aligned with flow bore 115 of LMRP 110, and is in fluid communication with flow bore 115 when rams 121*a, c* are open.

As best shown in FIG. 3, primary BOP stack 120 also includes a first set or bank 127 of hydraulic accumulators 127*a* mounted on primary BOP stack 120. While the primary hydraulic pressure supply is provided by hydraulic conduits 15 extending along riser 14, the accumulator bank 127 may be used to support operation of rams 121*a, c* (i.e., supply hydraulic pressure to actuators 126 that drive rams 121*a, c* of stack 120), choke/kill valves 131, connector 50*b* of primary BOP stack 120, and choke/kill connectors 130 of primary BOP stack 120. As will be explained in more detail below, accumulator bank 127 serves as a backup means to provide hydraulic power to operate rams 121*a, c*, valves 131, connector 50*b*, and connectors 130 of primary BOP stack 120.

Referring again to FIGS. 1-3, secondary BOP stack 150 comprises choke/kill valves 131, axially stacked ram BOPs 121, and a pair of control units 151. In this embodiment, choke/kill line connections 130 connect the female choke/kill line connectors of primary BOP stack 120 with the male choke/kill adapters of secondary BOP stack 150, thereby placing the choke/kill lines 132 of primary BOP stack 120 in fluid communication with choke/kill valves 131 of secondary BOP stack 150. However, in other choke/kill connections 130 between primary BOP stack 120 and secondary BOP stack 150 may be eliminated. In such other embodiments, choke/kill lines separate and independent of choke/kill lines 132 of primary BOP stack 120 may be employed and placed in fluid communication with choke/kill valves 131 of the secondary BOP stack 150.

A main bore 155 extends through secondary BOP stack 150 from primary BOP stack 120 at the upper end of stack 150 to wellhead 30 at the lower end of stack 150. In this embodiment, secondary BOP stack 150 includes two ram BOPs 121—one upper ram BOP 121 including opposed blind shear rams or blades 121*a* as previously described, and one lower ram BOP 121 including opposed blind shear rams or blades 121*a* as previously described. In other embodiments, a ram BOP (e.g., ram BOP 121) including opposed pipe rams (e.g., opposed pipe rams 121*c*) may also be included in the secondary BOP stack 150. However, in such alternative embodiments, the secondary BOP stack (e.g., stack 150) preferably includes at least one ram BOP including a pair of opposed blind shear rams. Opposed rams 121*a* of secondary BOP stack 150 are located in cavities that intersect main bore 155 and support rams 121*a* as they move into and out of main bore 155 between the closed and opened positions, respectively. Main bore 155 is coaxially aligned with main bore 125 of primary BOP stack 120 and wellhead 30, is in fluid communication with main bore 125 when opposed rams 121*a* are opened, and is in fluid communication with wellbore 11 via wellhead 30. As will be described in more detail below, control units 151 may be used to operate valves 131 and rams 121*a* of secondary BOP stack 150. In this embodiment, control units 151 are physically mounted to and self-contained on secondary BOP stack 150. Although secondary BOP stack 150 includes a plurality of ram BOPs 121 in this embodiment, in other embodiments, the secondary BOP stack (e.g., secondary BOP stack 150) may include valves (e.g., gate valves) instead of ram BOPs (e.g., ram BOPs 121) to close and seal main bore 155. In such other embodiments, the valves in the secondary BOP stack may be controlled and operated in the same manner as ram BOPs 121.

Although control units 151 may be used to operate choke/kill valves 131 of secondary BOP stack 150 in this embodiment, in other embodiments, the choke/kill valves of the secondary BOP stack (e.g., choke/kill valves 131 of secondary BOP stack 150) may be operated by the control pods of the primary BOP stack (e.g., control pods 114 of primary BOP stack 120) and/or by one or more subsea remotely operated vehicles (ROVs). Exemplary devices and systems for remotely operating subsea valves (e.g., choke/kill valves 131 of secondary BOP stack 150) with an ROV are disclosed in U.S. patent application Ser. No. 12/964,418 filed Dec. 9, 2010, and entitled "BOP Stack with a Universal Intervention Interface," which is hereby incorporated herein by reference in its entirety for all purposes.

As best shown in FIG. 3, secondary BOP stack 150 also includes an independent, dedicated set or bank 157 of hydraulic accumulators 157*a* mounted on secondary BOP stack 150. Accumulator bank 157 may be used to support operation of rams 121*a* of secondary BOP stack 150 (i.e., supply hydraulic pressure to actuators 126 that drive rams 121*a*), choke/kill valves 131 of stack 150, connector 50*b* of secondary BOP stack 150, choke/kill connector 130 of secondary BOP stack 150.

As previously described, in this embodiment, primary BOP stack 120 includes one annular BOP 113 and four sets of rams (one set of shear rams 121*a*, and three sets of pipe rams 121*c*), and secondary BOP stack 150 includes two sets of rams (two sets of shear rams 121*a*) and no annular BOP 113. However, in other embodiments, the primary and secondary BOP stacks (e.g., stacks 120, 150) may include different numbers of rams, different types of rams, different numbers of annular BOPs (e.g., annular BOP 113), or combinations thereof. Further, although LMRP 110 is shown and described as including one annular BOP 113, in other embodiments, the LMRP (e.g., LMRP 110) may include a different number of annular BOPs (e.g., two sets of annular BOPs 113). Further, although primary BOP 120 and secondary BOP 150 may be referred to as "stacks" since each contains a plurality of ram BOPs 121 in this embodiment, in other embodiments, primary BOP 120 and/or secondary BOP 150 may include only one rain BOP 121.

Both LMRP 110 and primary BOP stack 120 comprise re-entry and alignment systems 140 that allow the LMRP 110-BOP stack 120 and stack 120-secondary BOP stack 150 connections to be made subsea with all the auxiliary connections (i.e. control units, choke/kill lines) aligned. Choke/kill line connectors 130 interconnect choke/kill lines 132 and choke/kill valves 131 on stack 120 and secondary BOP stack 150 to choke/kill lines 133 on riser adapter 112. Thus, in this embodiment, choke/kill valves 131 of secondary BOP stack 150 are in fluid communication with choke/kill lines 133 on riser adapter 112 via choke/kill lines 132 of primary BOP stack 120 and connectors 130. However, in other embodiments, the choke/kill valves of the secondary BOP stack (e.g., choke/kill valves 131 of secondary BOP stack 150) may not be coupled to or in fluid communication with the choke/kill lines of the primary BOP stack (e.g., choke/kill lines 132 of primary BOP stack 120). Rather, the choke/kill valves of the secondary BOP stack may be connected to and in fluid communication with choke/kill lines that are completely separate and independent of the choke/kill lines of the primary BOP. Accordingly, in such alternative embodiments, no alignment system is provided between the primary BOP stack and the secondary BOP stack (e.g., primary BOP stack 120 includes no alignment system 140 to guide the orientation of stack 120 relative to secondary BOP stack 150).

Figure 4:
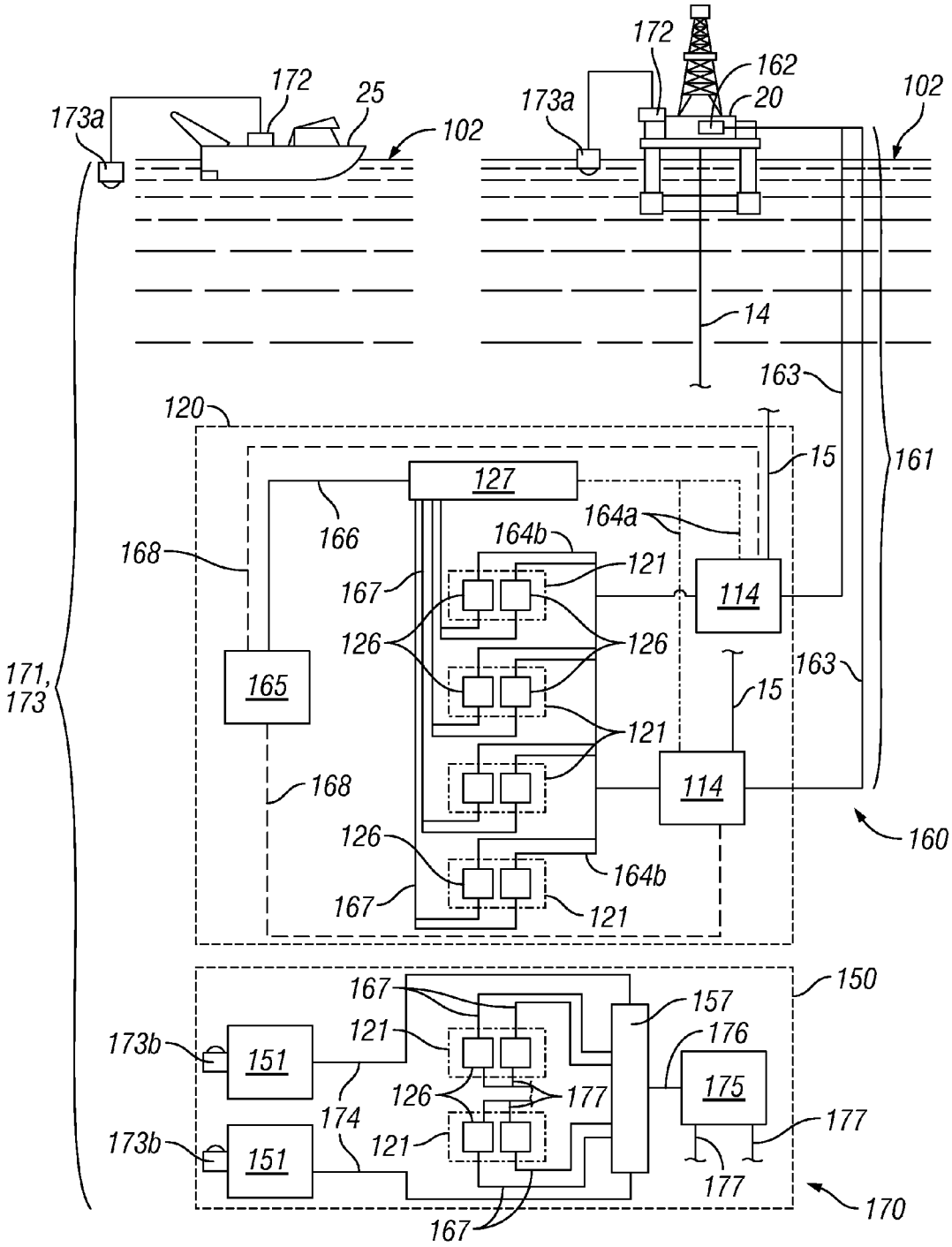
FIG. 4 is a schematic view of the control systems of the primary BOP stack and secondary BOP stack of FIGS. 1 and 2.

Referring now to FIG. 4, in this embodiment, primary BOP stack 120 is operated by a first or primary control system 160, and secondary BOP stack 150 is operated by a second or backup control system 170 that is distinct and separate from control system 160. Thus, secondary BOP stack 150 is controlled and operated independently from primary BOP stack 120. In general, primary control system 160 controls and operates the various actuators, valves, rams, connectors, and annular BOPs of LMRP 110 and primary BOP stack 120. For example, in this embodiment, control system 160 controls choke/kill valves 131, actuators 126 (and hence rams 121*a, c*), connectors 50*b*, and annular BOPs 113 of LMRP 110 and primary BOP stack 120. Backup control system 170 controls and operates the various actuators, valves, connectors, and rams of secondary BOP stack 150. For example, in this embodiment, backup control system 170 controls choke/kill valves 131, connector 50*b*, and actuators 126 (and hence rams 121*a*) of secondary BOP stack 150. For purposes of clarity, in FIG. 4, control system 160 is only shown coupled to accumulator bank 127 and actuators 126 of primary BOP stack 120, and control system 170 is only shown coupled to accumulator bank 157 and actuators 126 of secondary BOP stack 150.

In this embodiment, primary control system 160 operates each rain BOP 121 of primary BOP stack 120 via actuators 126 of primary BOP stack 120, but does not operate, and is not capable of operating, rain BOPs 121 of secondary BOP stack 150; and backup control system 170 operates rain BOPs 121 of secondary BOP stack 150 via actuators 126 of secondary BOP stack 150, but does not operate, and is not capable of operating, rain BOPs 121 of primary BOP stack 120. Thus, primary BOP stack 120 is controlled by primary control system 160, and secondary BOP Stack 150 is controlled by secondary control system 170.

Referring still to FIG. 4, in this embodiment, first control system 160 comprises a primary control sub-system 161 and a secondary or backup control sub-system 165. Primary control sub-system 161 controls the operation of rain BOPs 121 of primary BOP stack 120 as well as the actuators, valves, rams, connectors, and annular BOPs of LMRP 110 and primary BOP stack 120. Secondary control sub-system 165 serves as a backup means to operate rain BOPs 121 of primary BOP stack 120 when primary control sub-system 161 is unable to operate rain BOPs 121 of primary BOP stack 120.

Primary control sub-system 161 includes an operator control station or panel 162 disposed on platform 20 and the pair of subsea control pods 114 mounted to LMRP 110 as previously described. Central control pods 114 are redundant. Namely, each control pod 114 can perform all the functions of the other control pod 114. However, only one control pod 114 is used at a time, with the other control pod 114 providing backup. As used herein, the term "active" may be used to describe a subsea control unit (e.g., control pod 114) that is in use, whereas the term "inactive" may be used to describe a subsea control unit that is not in use and is serving as a backup to the active control unit. In this embodiment, the pair of central control pods 114 comprise blue and yellow control pods as are known in the art.

Each control pod 114 is coupled to control panel 162, accumulator bank 127, and each actuator 126 of primary BOP stack 120. In particular, a coupling 163 couples each control pod 114 to control panel 162, one or more hydraulic lines 164*a* couple each control pod 114 to accumulator bank 127, and hydraulic fluid supply lines 164*b* couple each control pod 114 to actuators 126 of primary BOP stack 120. One or more hydraulic conduit(s) 15 extending from vessel 20 supply pressurized hydraulic fluid to control pods 114 for actuating ram BOPs 121 via lines 164*b* and actuators 126 or charging accumulator bank 127 via lines 164*a*. Control pods 114 may also direct accumulator bank 127 to vent or dump pressurized hydraulic fluid to the surrounding sea.

Control panel 162 includes a user interface that allows an operator aboard platform 20 to enter control commands into panel 162, which communicates the control commands to each subsea control pod 114 through couplings 163. In this embodiment, each control pod 114 includes its own dedicated coupling 163 for communication with control panel 162, and further, each coupling 163 is an electrical conductor or cable that carries electronic control signals between panel 162 and control pods 114. Based on the control commands sent from control panel 162, the active control pod 114 controls actuators 126 with pressurized hydraulic fluid supplied through lines 15, 164*b*. For example, the electronic signal from panel 162 may operate electrical solenoids in active control pod 114 that direct pressurized hydraulic fluid through the appropriate hydraulic circuit to control actuators 126. Any one or more actuators 126 of primary BOP stack 120 may be independently controlled by the active control pod 114. Thus, for example, one set of opposed pipe rains 121*c* of primary BOP stack 120 may be actuated by themselves without actuating any of the other opposed rams 121*a, c* of primary BOP stack 120.

Secondary or backup control sub-system 165 of control system 160 provides a backup means to operate rain BOPs 121 of primary BOP stack 120 (e.g., in the event primary control sub-system 161 is unable to operate rain BOPs 121). In this embodiment, backup control sub-system 165 is coupled to accumulator bank 127 with a coupling 166, and actuators 126 of primary BOP stack 120 are coupled to accumulator bank 127 with hydraulic fluid supply lines 167. Thus, in response to control signals sent from the backup control sub-system 165, accumulator bank 127 supplies pressurized hydraulic fluid to actuators 126 to actuate ram BOPs 121.

In this embodiment, backup control sub-system 165 comprises a circuit that is electronically coupled to control pods 114 with couplings 168 and is automatically triggered to actuate one or more ram BOPs 121 of primary BOP stack 120 upon identification of a malfunction of primary control sub-system 161, inability of control sub-system 161 to actuate ram BOPs 121, or disconnection between control pods 114 and control panel 162. Coupling 166 is an electrical conductor or cable that transmits an electronic control signals from sub-system 165 to accumulator bank 127. Thus, once triggered, backup control sub-system 165 communicates a control signal to accumulator bank 127 via coupling 166, and accumulator bank 127 actuates one or more ram BOPs 121 of primary BOP stack 120 via lines 167 and actuators 126. Any one or more actuators 126 of primary BOP stack 120 may be independently controlled by backup control sub-system 165. Thus, for example, opposed blind shear rams 121*a* of primary BOP stack 120 may be actuated by themselves without actuating any of the other opposed rams 121*c* of primary BOP stack 120. In this embodiment, backup control sub-system 165 is an Automatic Shearing System (Autoshear), however, in other embodiments, the backup control sub-system (e.g., sub-system 165 may comprise any type of known automatic backup circuit for shutting-in a wellbore including, without limitation, a High Pressure Shear System (HPS), an Automatic Disconnect System (ADS), a Deadman system, or an Emergency Disconnect Sequences (EDS).

Referring still to FIG. 4, in this embodiment, secondary control system 170 includes a primary control sub-system 171 and a secondary or backup control sub-system 175. Primary control sub-system 171 controls the operation of ram BOPs 121 of secondary BOP stack 150 as well as the actuators, valves, rams, connectors, and annular BOPs of secondary BOP stack 150. Secondary control sub-system 175 serves as a backup means to operate ram BOPs 121 of secondary BOP stack 150 when primary control sub-system 171 is unable to operate ram BOPs 121 of secondary BOP stack 150.

Primary control sub-system 171 comprises a plurality of mobile operator control stations or panels 172 and subsea control units 151 mounted to secondary BOP stack 150. As shown in FIG. 4, at least one control panel 172 is disposed on vessel 20 and at least one control panel 172 is disposed on a surface vessel 25 that is separate and spaced apart from vessel 20. One or more control panels 172 may also be located on other vessels or at remote locations. Control units 151 are redundant. Namely, each control unit 151 can perform all of the functions of the other control unit 151. However, only one control unit 151 is used at a time, with the other control unit 151 providing backup. Thus, one control unit 151 is "active," while the other control unit 151 is "inactive."

Each control unit 151 is coupled to each control panel 172 and accumulator bank 157 of secondary BOP stack 150. In particular, a coupling 173 couples each control unit 151 to each control panel 172 and a coupling 174 couples each control unit 151 to accumulator bank 157. In this embodiment, couplings 174 are electrical wires or cables that transmit control signals between the active control unit 151 and accumulator bank 157. Actuators 126 of secondary BOP stack 150 are coupled to accumulator bank 127 with hydraulic fluid supply lines 167. Accumulator bank 157 supplies pressurized hydraulic fluid to actuators 126 to actuate ram BOPs 121 in response to control signals sent from the active control unit 151 via its corresponding coupling 174.

Each control panel 172 includes a user interface that allows an operator to enter control commands into that panel 172, which communicates the control commands to each subsea control unit 151 through coupling 173. In this embodiment, each control panel 172 communicates with subsea control units 151 with a dedicated coupling 174. Further, in this embodiment, each coupling 173 is a wireless, acoustic coupling including an acoustic transmitter/receiver 173*a* at or near the sea surface 12 and a subsea acoustic receiver 173*b*. One transmitter/receiver 173*a* is coupled to each control panel 172 and each transmitter/receiver 173*b* is coupled to one control unit 151. Each transmitter/receiver 173*a, b* is configured to both transmit and receive acoustic signals. However, for purposes of clarity and explanation, when a transmitter/receiver 173*a, b* is transmitting a signal, it may be referred to as a "transmitter," and when it is receiving a signal, it may be referred to as a "receiver."

Based on the control commands sent from any one control panel 172 and associated transmitter 173*a*, the active control unit 151 directs accumulator bank 157 via coupling 174 to control actuators 126 of secondary BOP stack 150 with pressurized hydraulic fluid supplied from accumulator bank 171 to actuators 126 via lines 167. Any one or more actuator 126 of secondary BOP stack 150 may be independently controlled by the active control unit 151. For example, opposed pipe rams 121*c* of secondary BOP stack 150 may be actuated by themselves without actuating the other opposed shear rams 121*a* of secondary BOP stack 150.

Secondary or backup control sub-system 175 of control system 170 provides a backup means to operate rain BOPs 121 of secondary BOP stack 150 (e.g., in the event primary control sub-system 171 is unable to operate rain BOPs 121). In this embodiment, backup control sub-system 175 is an emergency subsea ROV "hot stab" panel that allows a subsea ROV to directly actuate rain BOPs 121 via hydraulic lines 177 coupled to actuators 126. Accumulator bank 157 may also be charged via ROV panel 175 and hydraulic lines 176 extending from panel 175 to bank 157. For example, a subsea ROV with a bladder, pump, or hot line from the surface may supply pressurized hydraulic fluid to bank 157 via panel 175 and line 176. Although FIG. 4 does not illustrate secondary control system 170 as including a third or tertiary control sub-system, in other embodiments, the secondary control system (e.g., system 170) may further include a tertiary control system known in the art such as Automatic Shearing System (Autoshear), a High Pressure Shear System (HPS), an Automatic Disconnect System (ADS), a Deadman system, an acoustic system, or an Emergency Disconnect Sequences (EDS).

As previously described, primary BOP stack 120 and LMRP 110 are operated with control system 160, and secondary BOP stack 150 is operated control system 170. Control systems 160, 170 are completely independent of one another. Thus, in the event of a failure or malfunction of control system 160, LMRP 110, primary BOP stack 120, or combinations thereof, secondary BOP stack 150 can be controlled with control system 170 and function as a last resort option to contain wellbore 11. Further, it should be appreciated that at least one control panel 172 is physically located remote from platform 20 (i.e., control panel 172 is not disposed on platform 20), and thus, that remote control panel 172 can be employed to control secondary BOP stack 150 if platform 20 is evacuated, damaged, or sinks due to a blowout. Although control panel 172 is shown and described as being positioned in a vessel 25 at the sea surface 12, in general, control panel 172 may be positioned at any suitable location that is physically separated from platform 20. For example, control panel 172 may be positioned in another offshore platform, an ROV, or on land, provided a mechanism is provided for communicating control commands to transmitter 174*a*. Still further, communication couplings 173 are wireless, and thus, offers the potential to communicate with control units 151 even if there is no physical connection (e.g., riser, wire, hydraulic line, etc.) extending from subsea stack assembly 100 to the surface 12. Should sub-system 171 be unable to actuate rain BOPs 121 of secondary BOP stack 150, ROV panel 175 (and/or a tertiary control sub-system if provided) may be utilized to actuate ram BOPs 121 of secondary BOP stack 150.

Figure 5A:
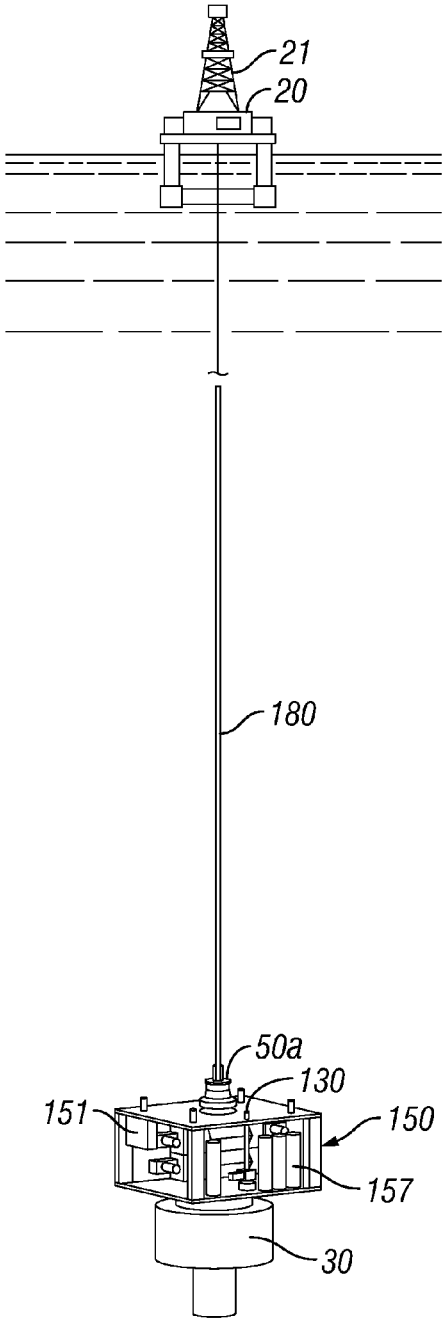
FIGS. 5A and 5B are schematic illustrations of the deployment of the subsea BOP stack assembly of FIGS. 1 and 2.
Figure 5B:
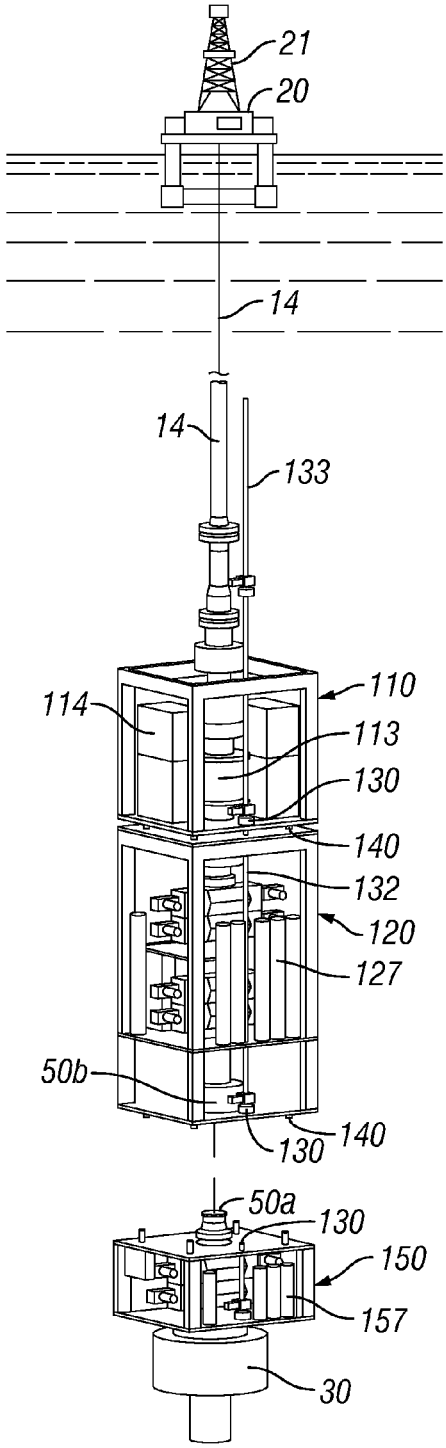

Referring now to FIGS. 1, 5A, and 5B, LMRP 110 and primary BOP stack 120 are similar to, and can operate as, a convention two-component stack assembly. Secondary BOP stack 150 is installed between wellhead 30 and primary BOP stack 120, and includes additional rams 121*a, c* to provide a backup or last resort option to contain and shut-in wellbore 11 in the event LMRP 110 and/or primary BOP stack 120 are unable to do so. As best shown in FIGS. 5A and 5B, in this embodiment, secondary BOP stack 150 is lowered subsea and installed on wellhead 30 separately from primary BOP stack 120 and LMRP 110. This separate deployment can be accomplished on drill pipe, heavy wireline, or any other means, either from the drilling rig if it has a dual activity derrick, from another rig (perhaps of lesser drilling capabilities), or from a heavy duty workboat or tender vessel. In this embodiment, secondary BOP stack 120 is lowered subsea to wellhead 30 on a pipe string 180 supported by derrick 21. Secondary BOP stack 120 is coaxially aligned with wellhead 30 and securely attached to wellhead 30 with wellhead-type connection 50 previously described. One or more ROVs may assist in the positioning and coupling of secondary BOP stack 150 to wellhead 30.

With secondary BOP stack 150 secured to wellhead 30, primary BOP stack 120 and LMRP 110 are lowered subsea together as a single assembly on conventional drilling riser 14, and landed on secondary BOP stack 150. The primary BOP stack 120 and LMRP 110 assembly is securely attached to secondary BOP stack 150 with wellhead-type connection 50 previously described. One or more ROVs may assist in the positioning and coupling of the primary BOP stack and LMRP 110 assembly to secondary BOP stack 150. During normal drilling operations, LMRP 110 and primary BOP stack 120 provide first layer of protection against a subsea blowout. However, in the event LMRP 110 and/or primary BOP stack 120 are incapable of containing wellbore 11, secondary BOP stack 150 may be relied on as a last resort option for controlling wellbore 11.

In the manner described, FIGS. 5A and 5B illustrate an exemplary deployment method in which the secondary BOP stack 150 is deployed subsea and installed on wellhead 30, followed by subsea deployment and installation of primary BOP stack 120 and LMRP 110 onto secondary BOP stack 150 as a single assembly. However, in other embodiments, secondary BOP stack 150, primary BOP stack 120, and LMRP 110 may be lowered subsea together as a single assembly on conventional drilling riser 14, and landed on wellhead 30 and securely attached to wellhead 30 with wellhead-type connection 50 previously described. One or more ROVs may assist in the positioning and coupling of the assembly to wellhead 30.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simply subsequent reference to such steps.

What is claimed is:

1. A system for drilling or producing a subsea wellbore, the system comprising:

a primary BOP comprising a primary ram BOP;

a first control unit operably coupled to the primary BOP;

a secondary BOP releasably connected to the primary BOP, the secondary BOP comprising a secondary ram BOP; and a second control unit operably coupled to the secondary BOP and releasably connected to the primary BOP;

wherein the first control unit is not capable of operating the secondary BOP; and wherein the second control unit is capable of operating the secondary BOP independently of the first control unit, even when released from the primary BOP.

2. The system of claim 1, wherein the secondary BOP is releasably connected to a subsea wellhead and positioned between the wellhead and the primary BOP.

3. The system of claim 2, further comprising an LMRP connected to the primary BOP, wherein the primary BOP is positioned between the LMRP and the secondary BOP.

4. The system of claim 1, wherein the primary BOP comprises a plurality of ram BOPs;

wherein the secondary BOP comprises a plurality of ram BOPs;

wherein each ram BOP includes a pair of opposed rams and a pair of actuators configured to actuate the pair of opposed rams;

wherein the primary BOP includes an accumulator bank configured to provide hydraulic pressure to the actuators of the primary BOP; and wherein the secondary BOP includes an accumulator bank configured to provide hydraulic pressure to the actuators of the secondary BOP.

5. The system of claim 4, wherein one of the plurality of ram BOPs of the primary BOP comprises a pair of opposed shear rams; and wherein one of the plurality of ram BOPs of the secondary BOP comprises a pair of opposed shear rams.

6. The system of claim 1, further comprising:

a first control system comprising the first control unit, the first control system coupled to the primary BOP and configured to operate the primary ram BOP of the primary BOP;

a second control system comprising the second control unit, the second control system coupled to the secondary BOP and configured to operate the secondary ram BOP of the secondary BOP.

7. The system of claim 6, wherein the first control system comprises a primary control sub-system including a first operator control panel positioned on a first vessel at the sea surface configured to transmit a first control signal to the first control unit to operate the primary ram BOP;

wherein the second control system comprises a primary control sub-system including a second operator control panel separate from the first operator control panel and positioned on a second vessel at the sea surface different than the first vessel, the second operator control panel configured to transmit a second control signal to the second control unit to operate the secondary ram BOP.

8. The system of claim 7, wherein the primary control sub-system of the second control system further comprises an acoustic transmitter coupled to the second operator control panel and an acoustic receiver coupled to each of the second subsea control units, wherein the acoustic transmitter is configured to wirelessly transmit the control signals to each of the acoustic receivers.

9. The system of claim 7, wherein the first control system further comprises a backup control sub-system configured to operate the primary ram BOP of the primary BOP; and wherein the second control system further comprises a backup control sub-system configured to operate the secondary ram BOP of the secondary BOP.

10. The system of claim 9, wherein the backup control sub-system of the second control system is an ROV hot stab panel coupled to the secondary ram BOP.

11. A method for containing a subsea wellbore, comprising:

operably coupling a first control unit to a primary BOP, wherein the primary BOP includes at least one ram BOP;

operably coupling a second control unit to a backup BOP, wherein the backup BOP includes at least one ram BOP; and lowering the backup BOP and second control unit subsea separately from the first control unit and primary BOP and mounting the backup BOP to a subsea wellhead at an upper end of the subsea wellbore;

further comprising operating the backup BOP with the second control unit independently of the first control unit.

12. The method of claim 11, further comprising:

lowering the primary BOP subsea and connecting the primary BOP to the backup BOP; and actuating the at least one ram BOP of the backup BOP in response to an inability to actuate the at least one ram BOP of the primary BOP.

13. The method of claim 11, wherein the primary BOP comprises a primary BOP stack including a plurality of ram BOPs.

14. The method of claim 13, further comprising:

lowering the primary BOP subsea and connecting the primary BOP to the backup BOP; and actuating the ram BOP of the backup BOP in response to an inability to actuate each ram BOP of the primary BOP stack.

15. The method of claim 11, wherein a first control system comprises the first control unit and a second control system comprises the second control unit, the method further comprising:

locating a first operator control panel of the first control system on a first vessel at the sea surface;

locating a second operator control panel of the second control system on a second vessel that is different than the first vessel.

16. The method of claim 11, wherein the at least one backup ram BOP of the backup BOP comprises a pair of opposed shear rams; and wherein the at least one ram BOP of the primary BOP comprises a pair of opposed shear rams.

17. The method of claim 15, further comprising:

sending a first control signal from the first operator control panel through the first control system to the primary BOP; and sending a second control signal from the second operator control panel through a second control system to the backup BOP.

18. The method of claim 17, wherein sending the second control signal comprises sending an acoustic signal from an acoustic transmitter coupled to the second operator control panel to an acoustic receiver coupled to the second subsea control unit.

19. A system for drilling or producing a subsea wellbore, the system comprising:

a primary BOP stack comprising a plurality of axially stacked ram BOPs;

a backup BOP releasably connected to the primary BOP stack, the secondary BOP comprising at least one ram BOP;

a first control system configured to operate each ram BOP of the primary BOP stack;

a second control system configured to operate each ram BOP of the backup BOP;

wherein the first control system includes an operator control panel disposed on a first vessel and a pair of redundant subsea control pods coupled to the primary BOP stack; and wherein the second control system includes an operator control panel disposed on a second vessel and a pair of redundant subsea control units coupled to the backup BOP.

20. The system of claim 19, wherein the operator control panel of the second control system is wirelessly coupled to each of the subsea control units of the second control system.

21. The system of claim 20, wherein the second control system further comprises an acoustic transmitter coupled to the operator control panel of the second control system and an acoustic coupling coupled to each of the control units of the second control system.

22. The system of claim 19, wherein the first control system is not configured to operate any of the ram BOPs of the backup BOP, and wherein the second control system is not configured to operate any of the ram BOPs of the primary BOP stack.

23. The system of claim 19, further comprising an LMRP coupled to the primary BOP stack, wherein the primary BOP stack is positioned between the LMRP and the backup BOP, and the backup BOP is positioned between the primary BOP stack and a wellhead.

24. The system of claim 19, wherein each ram BOP includes a pair of opposed rams and a pair of actuators configured to actuate the pair of opposed rams;

wherein at least one of the plurality of ram BOPs of the primary BOP stack comprises a pair of opposed shear rams; and wherein the of ram BOP of the backup BOP comprises a pair of opposed shear rams.

25. A system, comprising:

a first control system for operating a plurality of ram BOPs of a primary BOP stack;

a second control system for operating at least one ram BOP of a backup BOP;

wherein the first control system includes an operator control panel disposed on a first vessel and a pair of redundant subsea control pods for operating the ram BOPs of the primary BOP stack;

wherein the second control system includes an operator control panel disposed on a second vessel and a pair of redundant subsea control units for operating the ram BOP of the backup BOP.

26. The system of claim 25, wherein the operator control panel of the second control system is wirelessly coupled to each of the subsea control units of the second control system.

27. The system of claim 26, wherein the second control system further comprises an acoustic transmitter coupled to the operator control panel of the second control system and an acoustic coupling coupled to each of the control units of the second control system.

28. The system of claim 25, wherein the first control system is not configured to operate any of the ram BOPs of the backup BOP, and wherein the second control system is not configured to operate any of the ram BOPs of the primary BOP stack.

29. The system of claim 1, wherein the primary BOP is not operable by the second control unit.

* * * * *